US008926289B2

(12) United States Patent
Duong et al.

(10) Patent No.: US 8,926,289 B2
(45) Date of Patent: Jan. 6, 2015

(54) BLADE POCKET DESIGN

(75) Inventors: Loc Quang Duong, San Diego, CA (US); Xiaolan Hu, San Diego, CA (US); Nagamany Thayalakhandan, San Diego, CA (US); Gao Yang, San Diego, CA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 411 days.

(21) Appl. No.: 13/415,005

(22) Filed: Mar. 8, 2012

(65) Prior Publication Data

US 2013/0236326 A1 Sep. 12, 2013

(51) Int. Cl.
*F01D 5/18* (2006.01)

(52) U.S. Cl.
USPC ..... 416/232; 416/233

(58) Field of Classification Search
USPC ..... 416/232, 233
See application file for complete search history.

(56) References Cited

U.S. PATENT DOCUMENTS

| | | | |
|---|---|---|---|
| 1,416,701 | A | 5/1922 | Flanders |
| 2,410,588 | A | 11/1946 | Phelan et al. |
| 2,906,494 | A | 9/1959 | McCarty et al. |
| 2,944,342 | A | 7/1960 | Bartlett |
| 2,972,181 | A | 2/1961 | Hollis et al. |
| 2,977,089 | A | 3/1961 | McCarty et al. |
| 2,977,090 | A | 3/1961 | McCarty et al. |
| 3,135,496 | A | 6/1964 | Scheper, Jr |
| 3,498,728 | A | 3/1970 | Wood |
| 3,731,486 | A | 5/1973 | Poulain et al. |
| 3,836,279 | A | 9/1974 | Lee |
| 4,050,134 | A | 9/1977 | Warner et al. |
| 4,156,581 | A | 5/1979 | Higuchi |
| 4,395,827 | A | 8/1983 | Stowe et al. |
| 4,662,820 | A | 5/1987 | Sasada et al. |
| 4,741,667 | A | 5/1988 | Price et al. |
| 4,804,905 | A | 2/1989 | Ding et al. |
| 5,795,130 | A | 8/1998 | Suenaga et al. |
| 5,915,923 | A | 6/1999 | Tomita et al. |
| 6,068,443 | A | 5/2000 | Aoki et al. |
| 6,142,739 | A | 11/2000 | Harvey |
| 6,370,866 | B2 | 4/2002 | Marushima et al. |
| 6,393,829 | B2 | 5/2002 | Marushima et al. |
| 6,409,470 | B2 | 6/2002 | Allford et al. |
| 6,497,551 | B1 | 12/2002 | Hand et al. |
| 6,514,039 | B1 | 2/2003 | Hand |
| 6,546,713 | B1 | 4/2003 | Hidaka et al. |
| 6,568,191 | B2 | 5/2003 | Ikeguchi et al. |
| 6,574,966 | B2 | 6/2003 | Hidaka et al. |

(Continued)

FOREIGN PATENT DOCUMENTS

WO WO03029616 A1 4/2003

*Primary Examiner* — Dwayne J White
(74) *Attorney, Agent, or Firm* — Kinney & Lange, P.A.

(57) ABSTRACT

An airfoil includes a blade having a pocket recess therein and one or more features disposed within the pocket recess. The one or more features are configured to disrupt pressure oscillations within the pocket recess. In another embodiment, a blade is disclosed having a first wall and a second wall. The first wall is disposed on a suction side of the blade and the second wall is disposed on a pressure side of the blade. The second wall is connected to the first wall at a leading edge of the blade. Together the first wall and the second wall form a portion of a pocket recess and the pocket recess is disposed asymmetrically with respect to a camber line of the blade.

14 Claims, 5 Drawing Sheets

(56) References Cited

U.S. PATENT DOCUMENTS

| | | | | |
|---|---|---|---|---|
| 6,616,410 | B2 | 9/2003 | Grylls et al. | |
| 6,648,591 | B2 | 11/2003 | Collins | |
| 6,648,593 | B2 | 11/2003 | Motherwell et al. | |
| 6,685,426 | B2 | 2/2004 | Clark | |
| 6,719,527 | B2 | 4/2004 | Collins | |
| 6,735,957 | B2 | 5/2004 | Marushima et al. | |
| 7,028,486 | B2 | 4/2006 | Marushima et al. | |
| 7,028,487 | B2 | 4/2006 | Marushima et al. | |
| 7,491,033 | B2 | 2/2009 | Trishkin et al. | |
| 7,607,287 | B2 | 10/2009 | Reba et al. | |
| 7,669,637 | B2 | 3/2010 | Kubota et al. | |
| 7,901,183 | B1 | 3/2011 | Liang | |
| 2004/0163394 | A1 | 8/2004 | Marushima et al. | |
| 2005/0084380 | A1* | 4/2005 | Fett et al. | 416/233 |
| 2007/0148003 | A1 | 6/2007 | Trishkin et al. | |
| 2008/0306714 | A1 | 12/2008 | Ferrarese et al. | |
| 2009/0216910 | A1 | 8/2009 | Duchesneau | |
| 2010/0003137 | A1 | 1/2010 | Groll | |
| 2010/0276940 | A1 | 11/2010 | Khavari et al. | |
| 2010/0278632 | A1 | 11/2010 | Duong et al. | |
| 2010/0278633 | A1 | 11/2010 | Duong et al. | |
| 2010/0322768 | A1 | 12/2010 | Comandu et al. | |
| 2011/0081251 | A1 | 4/2011 | Biskup et al. | |
| 2011/0215585 | A1 | 9/2011 | Caires | |
| 2011/0293436 | A1* | 12/2011 | Di Florio et al. | 416/233 |
| 2012/0020793 | A1 | 1/2012 | McCracken et al. | |

* cited by examiner

BLADE POCKET DESIGN

BACKGROUND

Gas turbine engines typically include several stages including a fan, a compressor, a combustor, and a turbine. Some of these stages utilize rotating airfoils with shaped blades arranged in series. The blades convert thermal energy from the combusted gas into mechanical work used to turn a rotor. The blades positioned forward of the combustor are turned by the rotor to compress air entering the combustor.

Blades, including turbine blades in particular, can utilize a pocket recess which comprises a recess cavity that extends radially through the length of the blade. The pocket recess creates an opening at the tip of the blade. The pocket recess is used for efficiency purposes to reduce the weight of the blade and to reduce blade creep. During operation of the gas turbine engine, air flow enters and exits the pocket recess with rotation of the blade due to the law of conservation of mass.

During operation of the gas turbine engine, the blades have one or more harmonic frequencies that coincide with integer multiples of the blades rotational frequency (also called the blade pass frequency). If the blade reaches one of these harmonic frequencies, the blade will become excited and vibrate. Additionally, during engine operation various aero-excitation source frequencies can be created as air passes over components of the gas turbine engine including the blade. These source frequencies can be transmitted to the air, causing unsteady fluid pressure oscillations, which can be transmitted to the blade. If a blade resonance frequency coincides with an aero-excitation source frequency, an excitation occurs causing undesired vibrations in the blade.

The tip leakage flow is induced by a pressure difference between the pressure at the pressure surface of the blade and the pressure at the suction surface of the blade. This phenomenon is also true for blades that employ the pocket recess. The leakage flow over the blade pocket recess can excite and sustain a longitudinal aero-acoustic mode resulting in pressure fluctuations within the pocket recess and result in the generation of a loud tone noise of high sound pressure levels.

In addition to the generation of noise, a blade employing the pocket recess will experience aero-acoustic-mechanical coupling phenomenon if one of the natural frequencies of the blade coincides with the aero-acoustic pressure oscillation frequencies as a result from air entering and leaving the pocket recess. If such a coincidence occurs, force on the walls of the pocket recess (caused by acoustic pressure in the cavity along the wall interface) supplies energy that sustains blade vibrations. At the same time that blade vibrations are sustained, the acoustic pressure field in the cavity is strengthened by blade vibrations along the pocket wall interface. As a result of these phenomenon, blades can be become excited, damaged, or fail (in extreme instances) due to the force of resonance.

SUMMARY

An airfoil includes a blade having a pocket recess therein and one or more features are disposed within the pocket recess. The one or more features are configured to disrupt pressure oscillations within the pocket recess.

In another embodiment, a blade is disclosed having a first wall and a second wall. The first wall is disposed on a suction side of the blade and the second wall is disposed on a pressure side of the blade. The second wall is connected to the first wall at a leading edge of the blade. Together the first wall and the second wall form a portion of a pocket recess and the pocket recess is disposed asymmetrically with respect to a camber line of the blade.

Yet another embodiment includes a method for creating an airfoil. The method includes designing an airfoil with a blade having a pocket recess therein, performing at least one of an aero-acoustic and an aero-acoustic-mechanical coupling analysis on the blade, modifying the blade based upon the aero-acoustic and/or aero-acoustic-mechanical coupling analysis to have the pocket recess disposed asymmetrically with respect to a camber line of the blade and/or one or more features disposed within the pocket recess that are configured to disrupt pressure oscillations within the pocket recess, and fabricating the blade as modified and designed.

DETAILED DESCRIPTION

Approach and Model Formulations

Figure 1A:
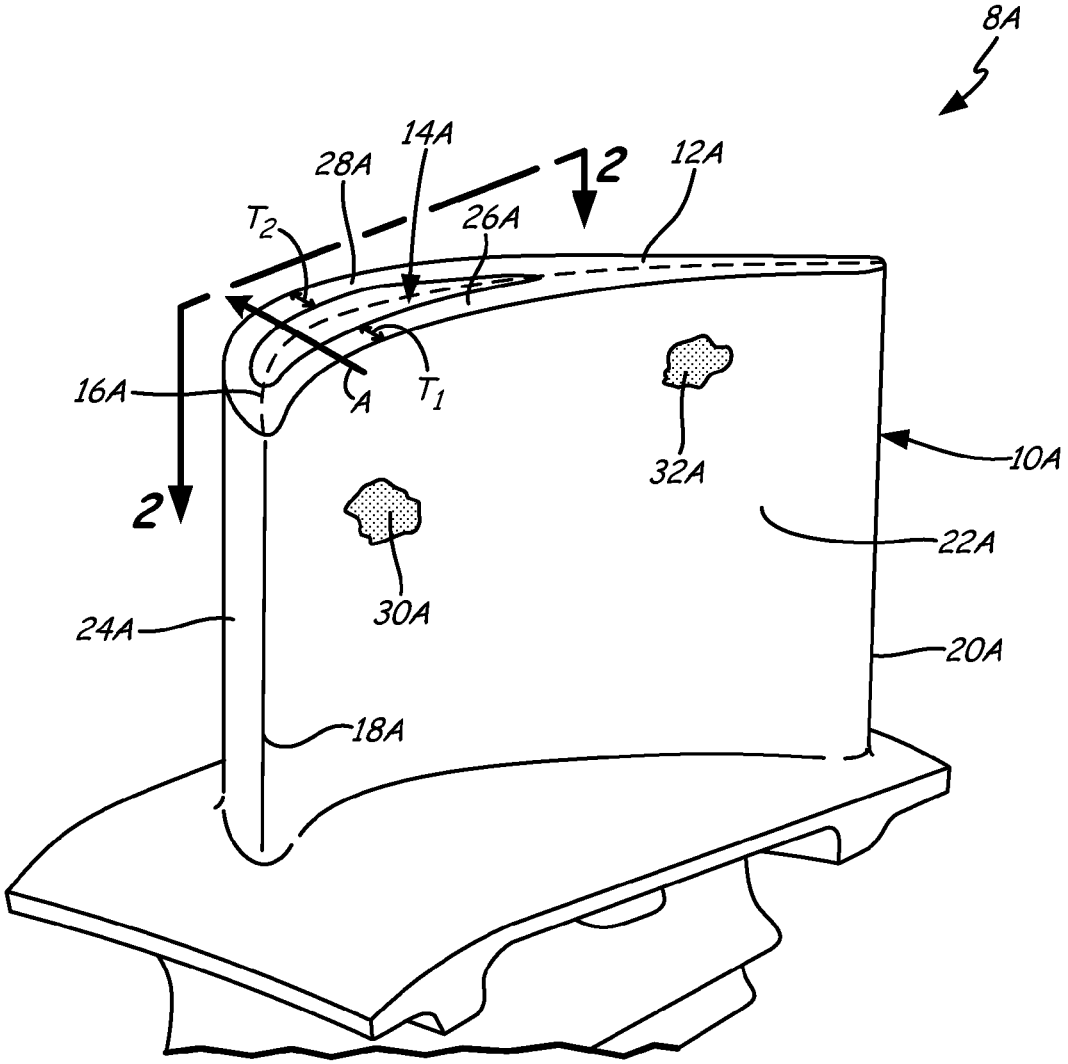
FIG. 1A is a perspective view of a first embodiment of an airfoil for a gas turbine engine including a symmetric pocket recess with walls having substantially a same thickness along a length of the pocket recess.

In general, the standard blade aero-acoustic-mechanical equation of motion is expressed in Equation (1) as follows:

$$[M]\{x''\}+[C]\{x'\}+[K]\{x\}=P(t) \tag{1}$$

Where: {x}=structural displacement, [M]=structural mass matrix, [C]=structural damping matrix, [K]=structural mass matrix, and P(t)=aero-acoustic excitation force.

To evaluate the response of the blade to the excitation source a reduced modal model is needed. Equation (2) expresses x(t) as linear combination of a limited number of orthogonal mode shapes:

$$x(t)=\Sigma_k\phi_k q_k=[\Phi] \tag{2}$$

Where: Φ are normal modes and q are normal or modal coordinates.

Neglecting the effects of damping, equation (1) may be rewritten as Equation (3):

$$[I]\{q''\}+[\omega_i^2]\{q\}=[\Phi]T\{p(\omega_g)\} \tag{3}$$

Where $\omega_i$ is the blade natural frequency, and $\omega_g$ is the excitation frequency.

With this reduced decoupled system, the response of each blade mode to the excitation source can be evaluated independently. Resonance occurs when the following condition is satisfied in Equation (4):

$$\omega_i=\omega_g \tag{4}$$

In the context of flow over pocket recess which induces aero-acoustic coupling phenomena, $\omega_g$ represents the acoustic pressure oscillation frequency inside the pocket recess.

For a simple rectangular cavity, the relationship between flow velocity in terms of Mach number, cavity geometry and cavity natural frequency could be expressed by the following correlation expressed in Equation (5):

$$St=(fL/U_\infty) \quad (5)$$

Where: St is the Strouhal number (a dimensionless parameter), f is the cavity natural frequency, L is the cavity length and $U_\infty$ is the flow velocity at the open cavity end.

The pocket recess of blade will have a number of natural acoustic frequencies. Due to the complexity of the pocket recess geometry, Computation Fluid Dynamics is used to estimate the natural acoustic frequencies of the pocket recess. Acoustic resonance occurs when tip leakage flow induces acoustic pressure oscillation generating a tone noise. Additionally, an aero-acoustic-mechanical coupling phenomenon will occur generating vibration in the blade when the acoustic pressure oscillation frequency coincides with the blade natural frequency as described by Equation (4). This means the force on the blade pocket walls, caused by acoustic pressure in the cavity along the wall interface, supplies energy that sustains the blade vibrations. At the same time the acoustic pressure field in the cavity is strengthened by the blade vibrations along the pocket wall interface.

Conclusions

From the above equations it is evident that occurrence of aero-acoustic coupling phenomena is dependent upon many variables including blade structure (mass, thickness, stiffness), flow velocity, and pressure oscillations.

The present invention describes various apparatuses and methods for reducing the likelihood of aero-acoustic coupling phenomena occurring for a blade with a pocket recess. More particularly, embodiments of the invention utilize one or more projections disposed within the pocket recess of the blade which act to disrupt pressure oscillations within pocket recess to weaken or decouple aero-acoustic interaction by altering the pressure field within the blade by disrupting flow (i.e., forcing flow around or into the features). Additionally, embodiments of the invention utilize a pocket cavity that is asymmetric with respect to a camber line of the blade. Such an arrangement alters the mass/stiffness of the blade, thereby shifting or tuning away the natural frequency of the pocket cavity and blade from the frequency of acoustic pressure oscillation.

More particularly, blade can be tuned at blade anti-nodes as further discussed in United States Patent Application Publications 2010/0278632A and 2010/0278633A, which are incorporated herein by reference. Tuning is performed by modifying the stiffness/mass (i.e. wall thickness) at one or more blade anti-nodes. Increasing the mass at the blade anti-node decreases natural frequency, and decreasing mass at blade anti-node increases natural frequency. Wall thickness as a result of pocket recess geometry can be modified until the natural frequency of the blade resonant mode shapes that have interferences are moved out of the expected acoustic pressure oscillation frequency and/or the aero-excitation frequency. Wall thickness as a result of the pocket recess geometry can be further modified to further increase a substantially resonance-free running range. If further tuning is desired, the pocket recess geometry can be modified on one or more additional blade anti-nodes until the blade has no natural frequencies that excite at the expected acoustic pressure oscillation frequency and/or the aero-excitation frequency. The natural frequency of the blade resonant mode shapes can be modeled using a finite element method.

Benefits

The invention reduces or prevents blades from experiencing aero-acoustic and aero-acoustic-mechanical coupling. Thus, the durability of the blade is increased and the likelihood of catastrophic failure due to high cycle fatigue is greatly reduced. Additionally, the present invention acts to stop or reduce the generation of a loud tone noise of high sound pressure level.

Embodiments

FIG. 1A shows a first embodiment of an airfoil 8A for a gas turbine engine including a blade 10A, a blade tip 12A, and a pocket recess 14A that is disposed symmetrically with respect to a camber line 16A of blade 10A. Blade 10A includes a leading edge 18A, a trailing edge 20A, a pressure surface 22A, and a suction surface 24A. Because pocket recess 14A is disposed symmetrically with respect to camber line 16A, a first wall 26A of the blade 10A has substantially a same thickness as a second wall 28A. Blade 10A includes a first anti-node 30A and a second anti-node 32A. Airflow A is illustrated passing over blade tip 12A and pocket cavity 14A.

Airfoil 8A of FIG. 1A is of conventional design and includes a blade 10A extending outward from a platform section (not numbered) and a root section (not numbered) to blade tip 12A. When installed blade tip 12A is disposed adjacent gas turbine engine stator case (not shown). Pocket recess 14A extends into blade 10A from blade tip 12A. In the embodiment shown in FIG. 1A, pocket recess 14A is symmetric with respect to camber line 16A of blade 10A. Thus, pocket recess 14A straddles and is bifurcated by camber line 16A, is disposed adjacent leading edge 18A in a thicker region of blade 10A, and is substantially equidistant from pressure surface 22A and suction surface 24A of blade 10A.

Blade 10A extends from leading edge 18A along concave pressure surface 22A and along convex suction surface 24A to trailing edge 20A. For reference purposes, camber line 16A extends along blade tip 12A from leading edge 18A to trailing edge 20A. Pocket recess 14A is separated from exterior of blade 10A and pressure surface 22A by first wall 26A. Similarly, pocket recess 14A is separated from exterior of blade 10A and suction surface 24A by second wall 28A. Because pocket recess 14A is symmetric with respect to camber line 16A, first wall 26A has substantially a same thickness ($T_1 \approx T_2$) as second wall 28A along a corresponding extent of pocket recess 14A.

Two of many possible anti-nodes for blade 10A are shown in FIG. 1A. First anti-node 30A and second anti-node 32A are points of greatest deflection should harmonic vibration occur in blade 10A. Location of anti-nodes 30A and 32A can be determined through eigenvalue solutions, in a manner known in the art.

Because the construction and operation of gas turbine engines is known in the art, gas turbine engines will not be discussed in great detail. While blade 10A is shown as a separate component removable from a rotor (not shown) in other embodiments airfoil can be integrated with the rotor. Although described with reference to a turbine airfoil, in other embodiments blade 10A can be utilized in the compressor or other stage of the gas turbine engine.

Figure 1B:
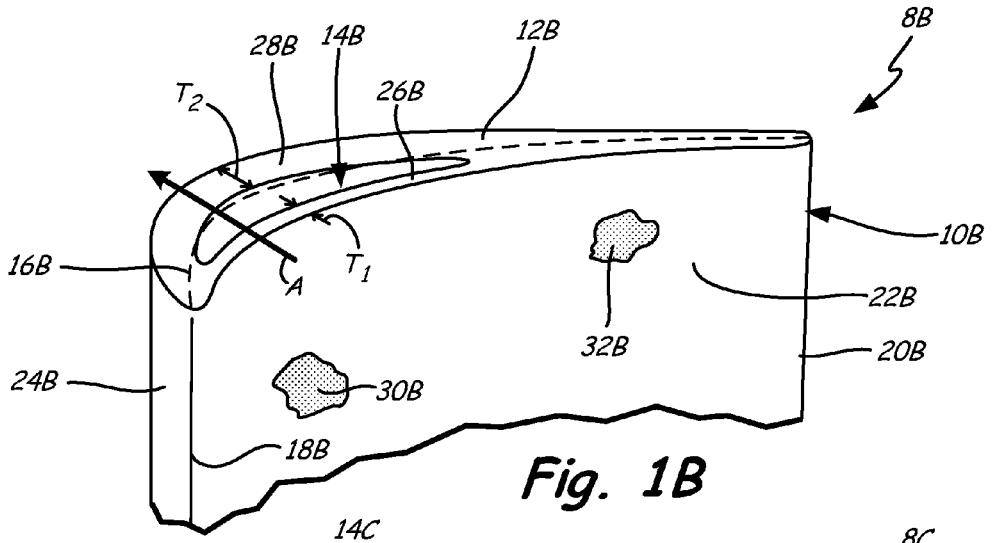
FIG. 1B is a perspective view of a second embodiment of the airfoil including an asymmetric pocket recess to provide for a thinner wall adjacent the pressure side of the airfoil.

FIG. 1B a perspective view of a second embodiment of an airfoil 8B for a gas turbine engine including a blade 10B, a blade tip 12B, and a pocket recess 14B that is disposed asymmetrically with respect to a camber line 16B to be disposed closer to a pressure surface 22B of blade 10B than a suction surface 24B. In addition to pressure surface 22B and suction surface 24B, blade 10B includes a leading edge 18B and a trailing edge 20B. Because pocket recess 14B is disposed asymmetrically with respect to camber line 16B, a first wall 26B of the blade 10B has a thickness $T_1$ that differs from a corresponding thickness $T_2$ of second wall 28B at a substantially similar location with respect to camber line 16B. Blade 10B includes a first anti-node 30B and a second anti-node 32B. Airflow A is illustrated passing over blade tip 12B and pocket cavity 14B.

Pocket recess 14B comprises a cavity that extends into blade 10B from blade tip 12B. Blade 10B extends from leading edge 18B along concave pressure surface 22B and along convex suction surface 24B to trailing edge 20B. For reference purposes, camber line 16B extends along blade tip 12B from leading edge 18B to trailing edge 20B. In the embodiment shown in FIG. 1B, pocket recess 14B is asymmetric with respect to camber line 16B of blade 10B. Thus, pocket recess 14B is biased toward the pressure side of camber line 16B. This configuration disposes pocket recess 14B closer to pressure surface 22B than suction surface 24B.

Pocket recess 14B is separated from exterior of blade 10B and pressure surface 22B by first wall 26B. Similarly, pocket recess 14B is separated from exterior of blade 10B and suction surface 24B by second wall 28B. Because pocket recess 14B is asymmetric with respect to camber line 16B, first wall 26B is of a thinner thickness ($T_1<T_2$) than second wall 28B along a corresponding extent of pocket recess 14B.

FIG. 1B shows first anti-node 30B and second anti-node 32B, which are points of greatest deflection should harmonic vibration occur in blade 10B. The size and location of one or more anti-nodes 30B and 32B has been shifted relative to that of anti-nodes 30A and 32A (FIG. 1A). This shift is due to the difference in location of pocket recess 14B relative to pocket recess 14A (FIG. 1A). By moving pocket recess 14B, the thickness (stiffness) of second wall 28B is changed and the stiffness of first wall 26B is also changed. This change in mass/thickness affects the harmonic frequencies of the pocket recess 14B and blade 10B, which are shifted away from the expected acoustic pressure oscillation frequency to reduce or eliminate aero-acoustic and/or aero-acoustic-mechanical coupling of blade 10B.

Figure 1C:
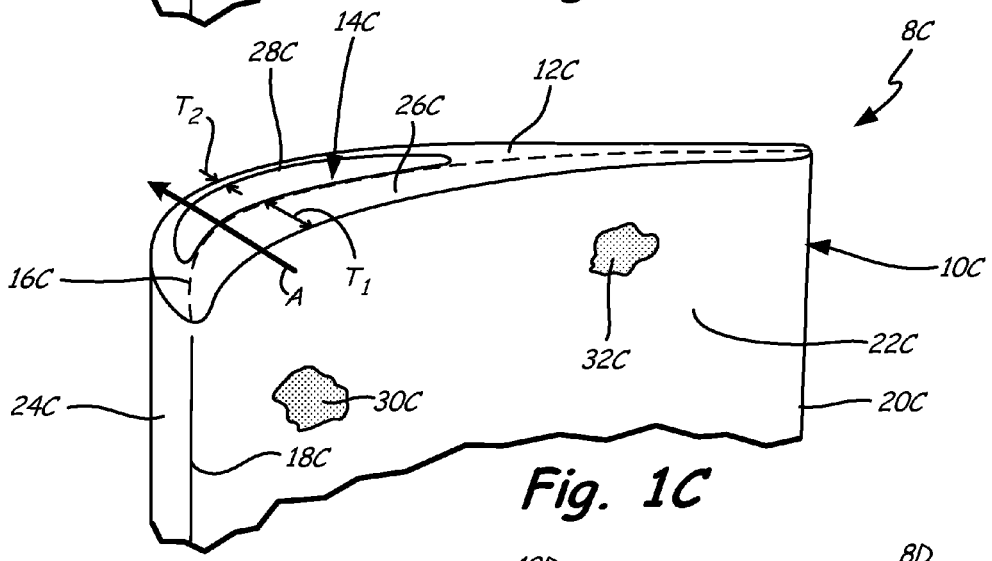
FIG. 1C is a perspective view of a third embodiment of the airfoil including an asymmetric pocket recess to provide for a thinner wall adjacent the suction side of the airfoil.

FIG. 1C shows a third embodiment of an airfoil 8C for a gas turbine engine including a blade 10C, a blade tip 12C, and a pocket recess 14C that is disposed asymmetrically with respect to a camber line 16C toward suction surface 24C of blade 10C. Blade 10C includes a leading edge 18C, a trailing edge 20C, a pressure surface 22C, and a suction surface 24C. Because pocket recess 14C is disposed asymmetrically with respect to camber line 16C, a first wall 26C of the blade 10C has a greater thickness $T_1$ than a corresponding thickness $T_2$ of a second wall 28C at a substantially similar location with respect to camber line 16C. Blade 10C includes a first anti-node 30C and a second anti-node 32C. Airflow A is illustrated passing over blade tip 12C and pocket recess 14C.

Pocket recess 14C extends into blade 10C from blade tip 12C. Blade 10C extends from leading edge 18C along concave pressure surface 22C and along convex suction surface 24C to trailing edge 20C. For reference purposes, camber line 16C extends along blade tip 12C from leading edge 18C to trailing edge 20C. In the embodiment shown in FIG. 1C, pocket recess 14C is asymmetric with respect to camber line 16C of blade 10C. Thus, pocket recess 14C is biased toward the suction side of camber line 16C. This configuration disposes pocket recess 14C closer to suction surface 24C than pressure surface 22C.

Pocket recess 14C is separated from exterior of blade 10C and pressure surface 22C by first wall 26C. Similarly, pocket recess 14C is separated from exterior of blade 10C and suction surface 24C by second wall 28C. Because pocket recess 14C is asymmetric with respect to camber line 16C, first wall 26C is of a thicker thickness ($T_1>T_2$) than second wall 28C along a corresponding extent of pocket recess 14C.

FIG. 1C shows first anti-node 30C and second anti-node 32C, which are points of greatest deflection should harmonic vibration occur in blade 10C. The size and location of one or more anti-nodes 30C and 32C has been shifted relative to that of anti-nodes 30A and 32A (FIG. 1A). This shift is due to the difference in location of pocket recess 14C relative to pocket recess 14A (FIG. 1A). By moving pocket recess 14C, the thickness (stiffness) of second wall 28C is changed and the stiffness of first wall 26C is also changed. This change in mass/thickness affects the harmonic frequencies of the pocket recess 14C and blade 10C, which are shifted away from the expected acoustic pressure oscillation frequency to reduce or eliminate aero-acoustic and/or aero-acoustic-mechanical coupling of blade 10C.

Figure 1D:
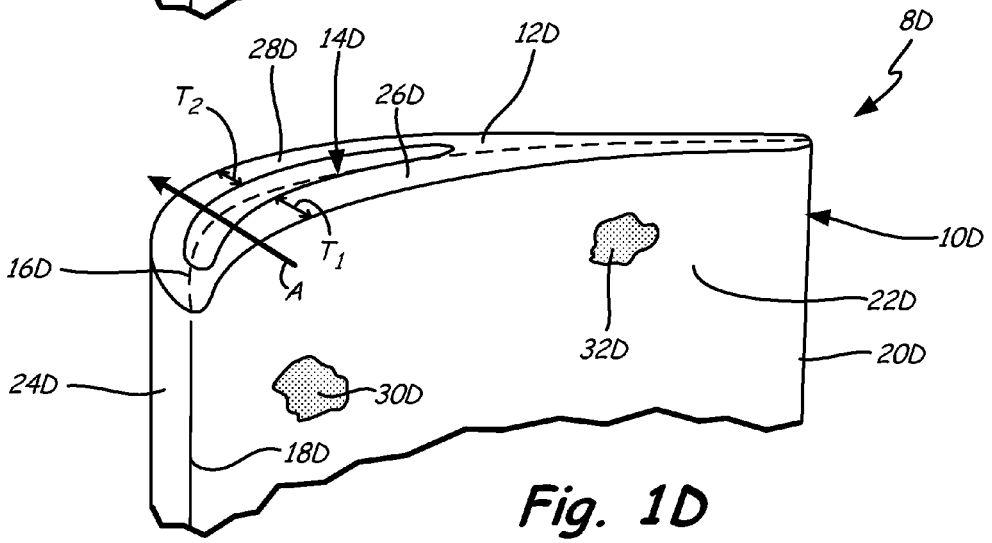
FIG. 1D is a perspective view of a fourth embodiment of the airfoil including an asymmetric pocket recess formed by a varying wall thickness along a camber line of the airfoil.

FIG. 1D shows a fourth embodiment of an airfoil 8D for a gas turbine engine including a blade 10D, a blade tip 12D, and a pocket recess 14D that is disposed asymmetrically with respect to a camber line 16D such that pocket recess 14D is angled with respect to camber line 16D. Blade 10D includes a leading edge 18D, a trailing edge 20D, a pressure surface 22D, and a suction surface 24D. Because pocket recess 14D is disposed asymmetrically with respect to camber line 16D, a first wall 26D of the blade 10D has increasing thickness along the axial length of pocket recess 14D from forward to aft and a second wall 28D with a decreasing thickness along the axial length of pocket recess 14D. In particular, first wall 26D has a lesser thickness $T_1$ adjacent leading edge 18D than aft near a trailing termination edge of pocket recess 14D. Similarly, a corresponding thickness $T_2$ of a second wall 28D is greater near the leading edge 18D and decreases in thickness with travel aft along pocket recess 14D. Thus, second wall 28D has decreasing thickness along the length of pocket recess 14D from forward to aft. Blade 10D includes a first anti-node 30D and a second anti-node 32D. Airflow A is illustrated passing over blade tip 12D and pocket recess 14D.

Pocket recess 14D extends into blade 10D from blade tip 12D. Blade 10D extends from leading edge 18D along concave pressure surface 22D and along convex suction surface 24D to trailing edge 20D. For reference purposes, camber line 16D extends along blade tip 12D from leading edge 18D to trailing edge 20D. In the embodiment shown in FIG. 1D, pocket recess 14D is asymmetric with respect to camber line 16D of blade 10D. Thus, pocket recess 14D creates wall 26D with increasing thickness forward to aft and creates wall 28D with decreasing thickness forward to aft. This configuration disposes pocket recess 14D at an offset angle from camber line 16D instead of being bifurcated by camber line as shown in the embodiment of FIG. 1A or offset from camber line as shown in the embodiments of FIGS. 1B and 1C.

Pocket recess 14D is separated from exterior of blade 10D and pressure surface 22D by first wall 26D. Similarly, pocket recess 14D is separated from exterior of blade 10D and suction surface 24D by second wall 28D. Because pocket recess 14D is asymmetric with respect to camber line 16D (i.e. disposed at an angle thereto), first wall 26C is thicker adjacent the leading edge 18D than second wall 28D at a substantially similar location with respect to camber line 16C. First wall 26D decreases in thickness $T_1$ along pocket recess 14D from forward to aft. Second wall 28D increases in thickness $T_2$ along pocket recess 14D from forward to aft. Thus, in the embodiment shown in FIG. 1D, at aft portion of pocket recess 14D, the thickness of the second wall 28D is less than the thickness of the first wall 26D ($T_2<T_1$).

FIG. 1D shows first anti-node 30D and second anti-node 32D, which are points of greatest deflection should harmonic vibration occur in blade 10C. The size and location of one or more anti-nodes 30D and 32D has been shifted relative to that of anti-nodes 30A and 32A (FIG. 1A). This shift is due to the difference in location of pocket recess 14D relative to pocket recess 14A (FIG. 1A). By moving pocket recess 14D, the thickness (stiffness) of second wall 28D is changed and the stiffness of first wall 26D is also changed. This change in mass/thickness affects the harmonic frequencies of the pocket recess 14D and blade 10D, which are shifted away from the expected acoustic pressure oscillation frequency to reduce or eliminate aero-acoustic mechanical coupling of blade 10D.

Figure 2:
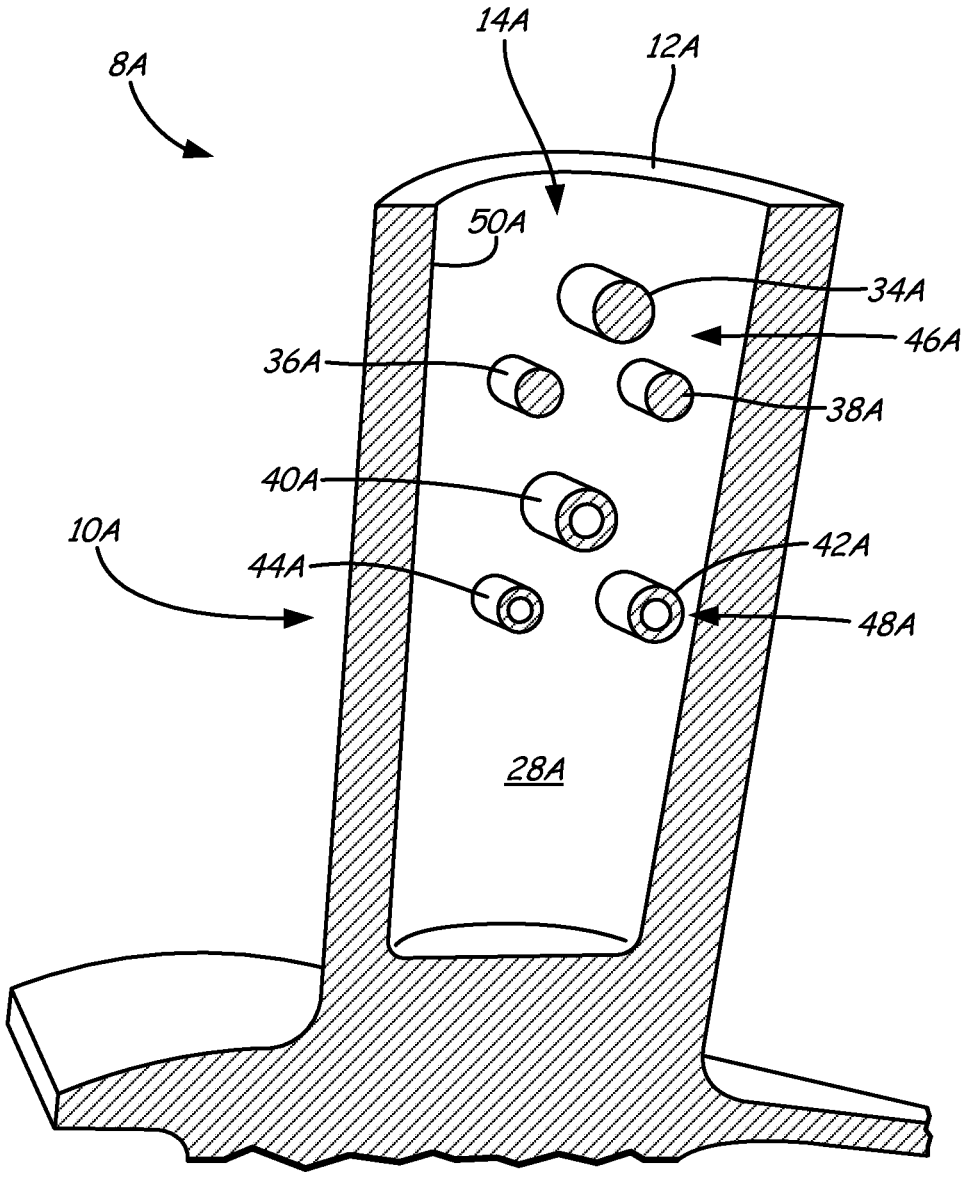
FIG. 2 is a sectional view of the airfoil of FIG. 1A showing the interior of the pocket recess which includes a plurality of projections therein.
Figure 2A:
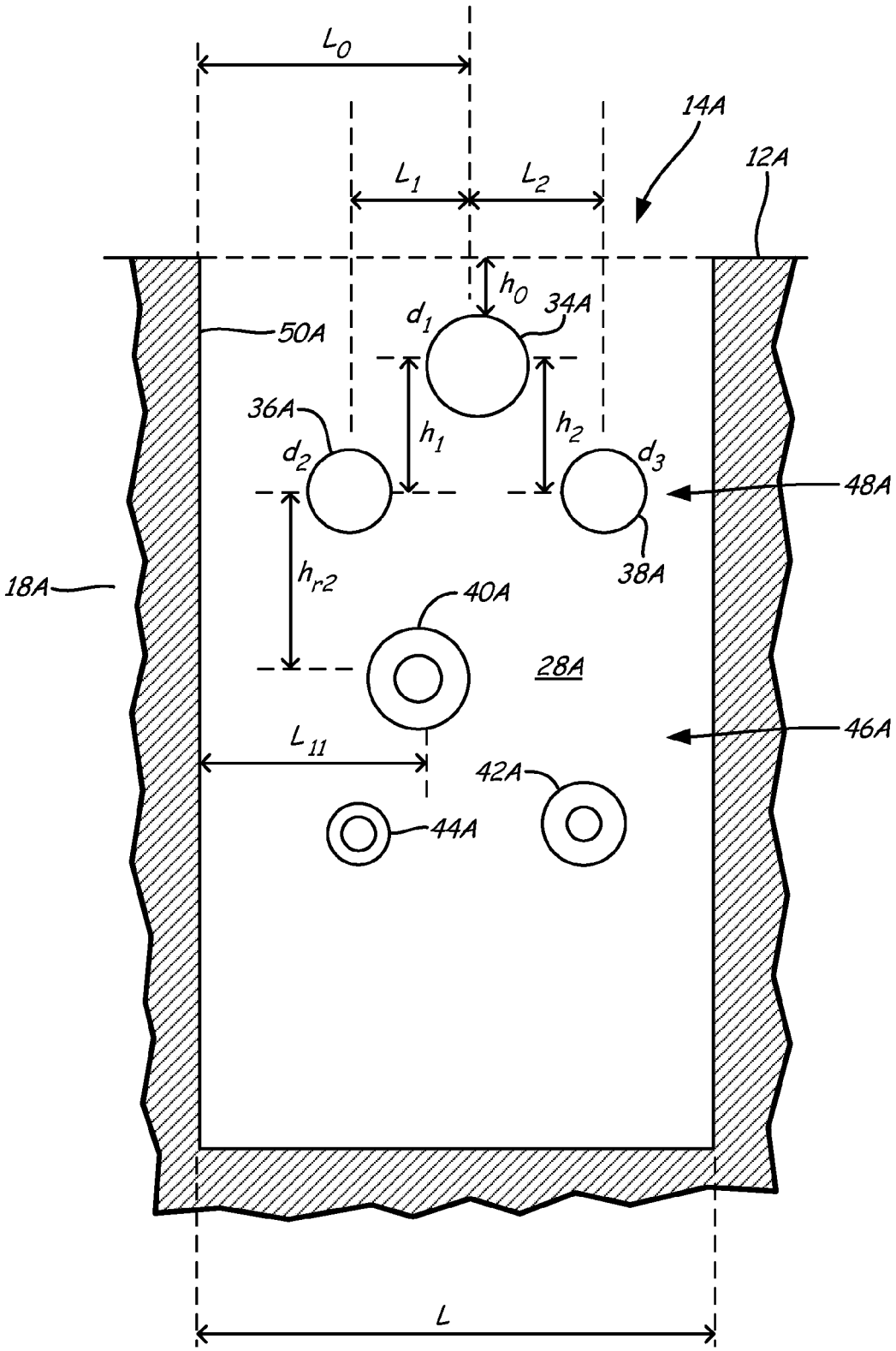
FIG. 2A is side view of the pocket recess of the airfoil of FIG. 2 showing arrays of a plurality of projections.

FIG. 2 shows a sectional view of the airfoil 8A of FIG. 1A showing the interior of pocket recess 14A. FIG. 2A shows a side view of pocket recess 14A. Blade 10A includes a plurality of features 34A, 36A, 38A, 40A, 42A, and 44A extending from second wall 28D. In the embodiment shown in FIGS. 2 and 2A, features 34A, 36A, 38A, 40A, 42A, and 44A are arranged into a first array 46A and a second array 48A.

Although illustrated in reference to the symmetric pocket recess 14A, the invention is equally applicable to the asymmetric pocket recess configuration including the embodiments shown in FIGS. 1B-1D. Although illustrated as pin like projections in FIGS. 2 and 2A, features 34A, 36A, 38A, 40A, 42A, and 44A may have different cross-sectional shapes such as an oval shape or a square cross-section. As shown in FIG. 2A, features 40A, 42A, and 44A can have a hollow cross-section. Indeed, projections can comprise a feature of any shape, including a bowl depression shape, which is capable of disrupting pressure oscillations within pocket recess 14A to weaken or decouple aero-acoustic interaction.

Features 34A, 36A, 38A, 40A, 42A, and 44A extend from second wall 28A of pocket recess 14A. In one embodiment, features 34A, 36A, 38A, 40A, 42A, and 44A extend across the entire pocket 14A to contact first wall 26A (FIGS. 1A-1D). Alternatively, features 34A, 36A, 38A, 40A, 42A, and 44A can extend only of a portion of the distance across pocket recess 14A to disrupt pressure oscillations. Similar, to second wall 28A, first wall 26A (not shown) can have one or more arrays of features. These may correspond to features on second wall 28A or be located at a different location from features on second wall 28A. In one embodiment, features 34A, 36A, 38A, 40A, 42A, and 44A can be made from the same material with blade 12A or from material with equivalent thermal coefficient of expansion but of lower density than blade 12A.

The location of each projection 34A, 36A, 38A, 40A, 42A, and 44A and array 46A and 48A is determined from Computational Fluid Dynamics (CFD) analysis. Axial length Lo corresponds to first array 46A. Lo represents the axial length from leading edge 50A of pocket cavity 14A to the location where dominant interaction between the free stream shear layer and cavity pressure oscillation occurs. Axial length $L_{11}$ corresponds to second array 48A and represents the axial length from leading edge 50A of pocket cavity 14A to the location where dominant interaction between the free stream shear layer and cavity pressure oscillation occurs.

First and second arrays 46A and 48A are illustrated as comprising three sets of projections each. In particular, first array 46A includes features 34A, 36A, and 38A. Second array 48A includes features 40A, 42A, and 44A. Although arranged in a generally triangular shape in FIGS. 2 and 2A, first and second arrays 46A and 48A (and any additional arrays) can be configured in any particular arrangement shape.

Similarly, the diameters of features 34A, 36A, 38A, 40A, 42A, and 44A can be of different sizes. The diameter of features 34A, 36A, 38A, 40A, 42A, and 44A can be calculated utilizing CFD analysis, such that the maximum vertical pressure interruption is achieved. Although all projections are illustrated as having a cylindrical shape, projections can have various different cross-sectional shapes from one another in other embodiments.

Distances ($h_{r2}$) between first and second arrays 46A and 48A (and any additional arrays) and between features 34A, 36A, 38A, 40A, 42A, and 44A can be determined with CFD analysis. Similarly, distances ($h_1$, $h_2$, $L_1$, $L_2$) between features 34A, 36A, 38A, 40A, 42A, and 44A in the same array can be determined from CFD analysis. Depending upon the aero-acoustic interaction strength and also upon the pocket recess 14A volume, multiple arrays can be utilized in the blade chord direction and/or be used deeper into pocket away from blade tip 12A.

Figure 3:
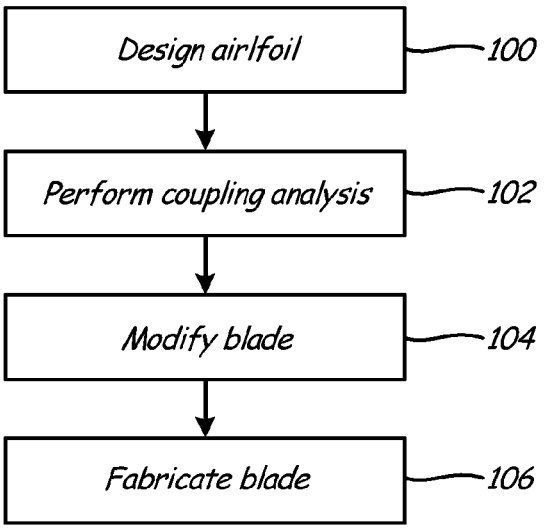
FIG. 3 is a flow chart of a method of creating an airfoil including a pocket recess.

FIG. 3 shows a flow chart of a method of creating an airfoil (such as the airfoil 8A of FIG. 1A) including a pocket recess. The method begins at step 100 by designing an airfoil 8A with blade 10A having pocket recess 14A therein. In step 100, airfoil 8A can be physically fabricated, or an electronic model of airfoil 8A can be created. The method proceeds to step 102 where an aero-acoustic and/or an aero-acoustic-mechanical coupling analysis is performed on the blade 10A. In the embodiments described, aero-acoustic coupling analysis and aero-acoustic-mechanical coupling analysis includes determining a flow field of the pocket recess 14A utilizing CFD software. Similarly, CFD analysis can be used to determine a flow field outside the pocket recess 14A adjacent the blade tip 12A. Aero-acoustic coupling analysis and aero-acoustic-mechanical coupling analysis of step 102 can also include performing a blade modal analysis to determine a natural frequency of the blade using a finite element method.

At step 104, the blade 10A is modified based upon the aero-acoustic coupling analysis and/or aero-acoustic-mechanical coupling analysis of step 102. If aero-acoustic coupling phenomena and/or an aero-acoustic-mechanical coupling phenomena is determined to be likely to occur, the blade 10A is modified to: (1) dispose the pocket recess asymmetrically with respect to a camber line 16A of the blade, (2) dispose one or more features (e.g., features 34A, 36A, 38A, 40A, 42A, and 44A of FIGS. 2 and 2A) within the pocket recess 14A to disrupt pressure oscillations within the pocket recess, (3) or incorporate both embodiments (1) and (2). The one or more features can be modified based on selection of at least one of a size, shape, number, and location of the one or more features. The one or more features are additionally arrayed in a desired pattern within the pocket recess 14A. At step 106 the blade 10A is fabricated as modified and designed using techniques such as forging and machining.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. An airfoil comprising:

a blade having a pocket recess therein; and one or more features disposed within the pocket recess with at least one of the one or more features having a hollow cylindrical shape, wherein the one or more features are configured to disrupt pressure oscillations within the pocket recess.

2. The airfoil of claim 1, wherein the one or more features comprise projections that extend from a blade first blade wall into the pocket recess.

3. The airfoil of claim 2, wherein the projections extend across the pocket recess and connect to a second blade wall.

4. The airfoil of claim 2, wherein both the first wall and a second blade wall have projections that extend into the pocket recess.

5. The airfoil of claim 1, wherein the one or more features are disposed in an array having at least two features.

6. The airfoil of claim 1, wherein the pocket includes two or more arrays.

7. The airfoil of claim 5, wherein the array has three pins arranged in a triangular shape.

8. The airfoil of claim 1, wherein the pocket recess is disposed asymmetrically with respect to a camber line of the blade.

9. An blade comprising:

a first wall disposed on a suction side of the blade; and a second wall disposed on a pressure side of the blade and connected to the first wall at a leading edge of the blade, wherein together the first wall and the second wall form a portion of a pocket recess, and wherein the pocket recess is disposed asymmetrically with respect to a camber line of the blade so the pocket recess is biased toward a pressure side of the camber line such that the first wall of the blade has a thickness that differs from a thickness of the second wall at a corresponding location.

10. The blade of claim 9, and further comprising one or more features disposed within the pocket recess, wherein the one or more features are configured to disrupt pressure oscillations within the pocket recess.

11. An blade comprising:

a first wall disposed on a suction side of the blade; and a second wall disposed on a pressure side of the blade and connected to the first wall at a leading edge of the blade, wherein together the first wall and the second wall form a portion of a pocket recess, and wherein the pocket recess is disposed asymmetrically with respect to a camber line of the blade and is disposed asymmetrically along an entire span of the blade.

12. The blade of claim 11, wherein the pocket recess is disposed asymmetrically such that the thickness of the first wall at the leading edge differs from the thickness of the first wall aft of the leading edge.

13. The blade of claim 11, wherein the first wall of the blade has an increasing thickness along the axial length of the pocket recess from forward to aft and the second wall has a decreasing thickness along the axial length of the pocket recess from forward to aft.

14. The blade of claim 11, and further comprising one or more features disposed within the pocket recess, wherein the one or more features are configured to disrupt pressure oscillations within the pocket recess.

* * * * *